US006254997B1

(12) United States Patent
Rettig et al.

(10) Patent No.: US 6,254,997 B1
(45) Date of Patent: Jul. 3, 2001

(54) ARTICLE WITH METALLIC SURFACE LAYER FOR HEAT TRANSFER AUGMENTATION AND METHOD FOR MAKING

(75) Inventors: Mark G. Rettig; Gilbert Farmer, both of Cincinnati; Thomas J. Tomlinson, West Chester; Robert G. Zimmerman, Jr., Morrow; Bhupendra K. Gupta, Cincinnati, all of OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/213,399

(22) Filed: Dec. 16, 1998

(51) Int. Cl.[7] ..... B32B 18/16; B22F 7/04; C23C 4/12

(52) U.S. Cl. ..... 428/553; 428/612; 428/628; 428/678; 428/680; 428/937; 416/241 R; 416/241 B

(58) Field of Search ..... 428/937, 628, 428/553, 612, 678, 680; 416/241 R, 241 B

(56) References Cited

U.S. PATENT DOCUMENTS

| | | | | |
|---|---|---|---|---|
| 3,806,276 | * | 4/1974 | Aspinwall . | |
| 4,027,367 | | 6/1977 | Rondeau | 428/652 |
| 4,293,785 | | 10/1981 | Jackson | 310/64 |
| 4,392,355 | * | 7/1983 | Verdouw . | |
| 4,642,027 | | 2/1987 | Popp | 415/177 |
| 4,659,282 | | 4/1987 | Popp | 415/177 |
| 4,663,243 | | 5/1987 | Czikk et al. | 428/559 |
| 4,890,669 | | 1/1990 | Zohler | 165/133 |
| 5,137,422 | | 8/1992 | Price et al. | 415/200 |
| 5,236,745 | * | 8/1993 | Gupta et al. . | |
| 5,294,462 | | 3/1994 | Kaiser et al. | 427/446 |
| 5,329,773 | * | 7/1994 | Myers et al. . | |
| 5,403,669 | * | 4/1995 | Gupta et al. . | |
| 5,482,734 | | 1/1996 | Herwig et al. | 427/8 |
| 5,498,484 | * | 3/1996 | Duderstadt . | |
| 5,817,371 | * | 10/1998 | Gupta et al. . | |
| 5,817,372 | * | 10/1998 | Zheng . | |
| 5,900,283 | * | 5/1999 | Vakil et al. . | |
| 5,993,976 | * | 11/1999 | Sahoo et al. . | |
| 6,020,075 | * | 2/2000 | Gupta et al. . | |

FOREIGN PATENT DOCUMENTS 2 320 929 * 8/1998 (GB) .

* cited by examiner

*Primary Examiner*—Deborah Jones
*Assistant Examiner*—Jason Savage
(74) *Attorney, Agent, or Firm*—Andrew C. Hess; Gerry S. Gressel

(57) ABSTRACT

An article comprising a substrate and an outer metallic layer, such as a coating, is provided with augmented heat transfer from the substrate through the combination of a layer thickness of about 0.003" to about 0.017", a layer surface roughness of at least about 500 micro inches Ra, a layer tensile bond strength of at least about 5 ksi, and a heat transfer augmentation of at least about 1.1. A method of making the article uses an electric arc wire thermal spray process in which the atomizing gas pressure is maintained within the range of about 20–80 psi.

6 Claims, 4 Drawing Sheets

ARTICLE WITH METALLIC SURFACE LAYER FOR HEAT TRANSFER AUGMENTATION AND METHOD FOR MAKING

BACKGROUND OF THE INVENTION

This invention relates to articles operating at relatively high temperatures; and more particularly, to such articles the efficiency of which can be enhanced by removal of heat therefrom during operation.

Hot operating components of gas turbine engines, for example those designed to operate in engine portions from the combustion section toward the rear of the engine, are benefited by means to remove heat from such articles. Such components or articles include combustion chamber parts, exhaust liners, various flaps and seals, and turbine section parts including frames. nozzles, blade platforms and ducts. Reduction in heat can allow the component, and hence the engine, to operate at higher, more efficient temperatures, as well as extend the operating life of the component. It is common practice and widely reported in the gas turbine art to use cooling air for such heat reduction. However, there is a limit to the amount of cooling air available for such use, and design of the engine must balance design operating temperatures with cooling air availability.

BRIEF SUMMARY OF THE INVENTION

The present invention, in one form, provides an article comprising a substrate and a metallic outer surface layer having characteristics which augment heat transfer from the article. Such a metallic outer surface layer comprises a layer thickness of about 0.003"–0.017" in combination with a layer surface roughness of greater than about 500 micro inches average layer surface roughness (Ra).

DETAILED DESCRIPTION OF THE INVENTION

In order to augment removal of heat from a high temperature operating metallic component of a gas turbine engine, a variety of metallic surface layers in the form of metallic coatings bonded with a substrate were evaluated in connection with the present invention. Used in the evaluation were metallic coatings deposited on and bonded with a metal substrate by an electric arc spray method which can deposit a relatively rough layer.

Figure 1:
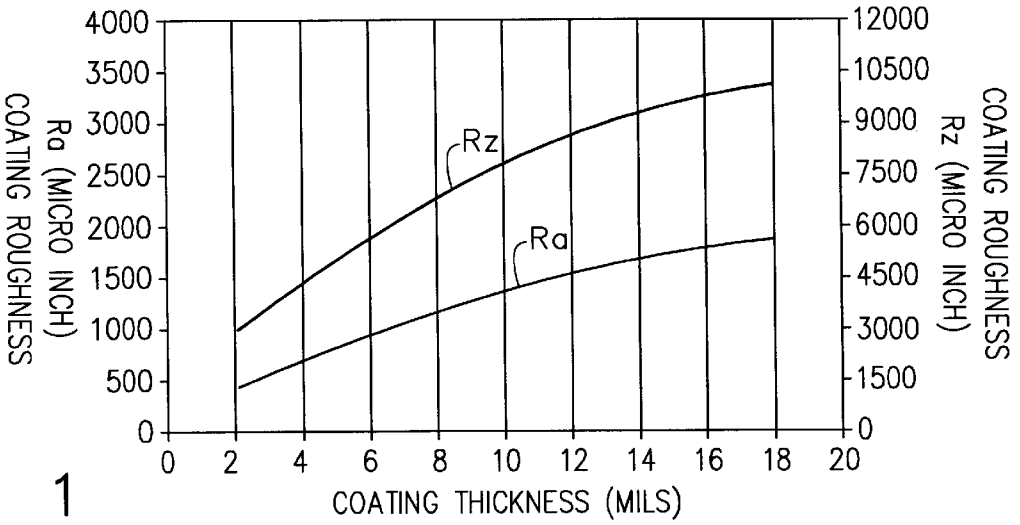
FIG. 1 is a graph comparing surface roughness characteristics with a coating thickness.
Figure 2:
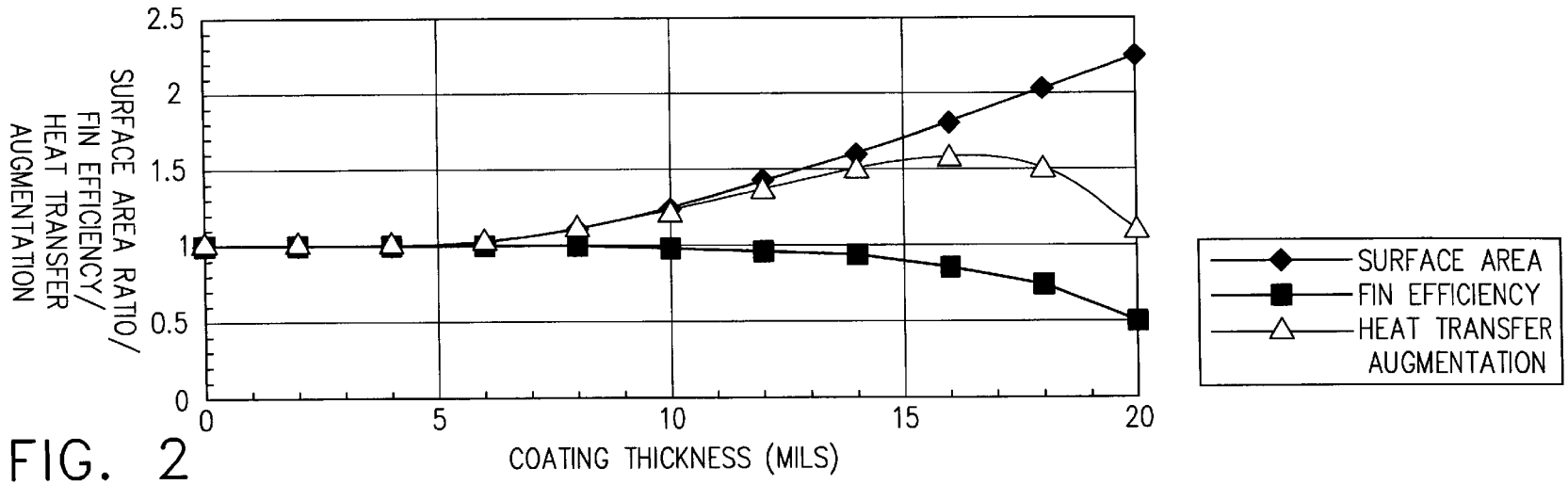
FIG. 2 is a graph comparing surface area ratio, fin efficiency and heat transfer augmentation with a coating thickness.

It was recognized that as the coating thickness increased, the surface roughness increased. This is shown in the graph of FIG. 1 comparing coating thickness with surface roughness. As used herein and in FIG. 1, Ra is the average layer or coating surface roughness and Rz is the mean peak-to-valley coating surface height, both in micro inches. Therefore in theory, for a coating made from a perfect thermal conductor, heat transfer augmentation should increase with surface roughness. However, it was recognized in connection with the present invention, that the actual thermal conductivity of such a coating causes the roughness to act as a fin. As a result, heat transfer from a rough surface under some conditions does not always increase as layer thickness increases. This is shown in the graph of FIG. 2 in which the layer is a coating, comparing surface area ratio (the ratio of roughened coated surface area to uncoated smooth surface), fin efficiency and heat transfer with coating thickness. It should be noted in FIG. 2 that the actual heat transfer augmentation declines after a coating thickness of about 17 mils (0.017"). In the absence of a coating or layer, the values at the "y" axis of would be 1.

Figure 3:
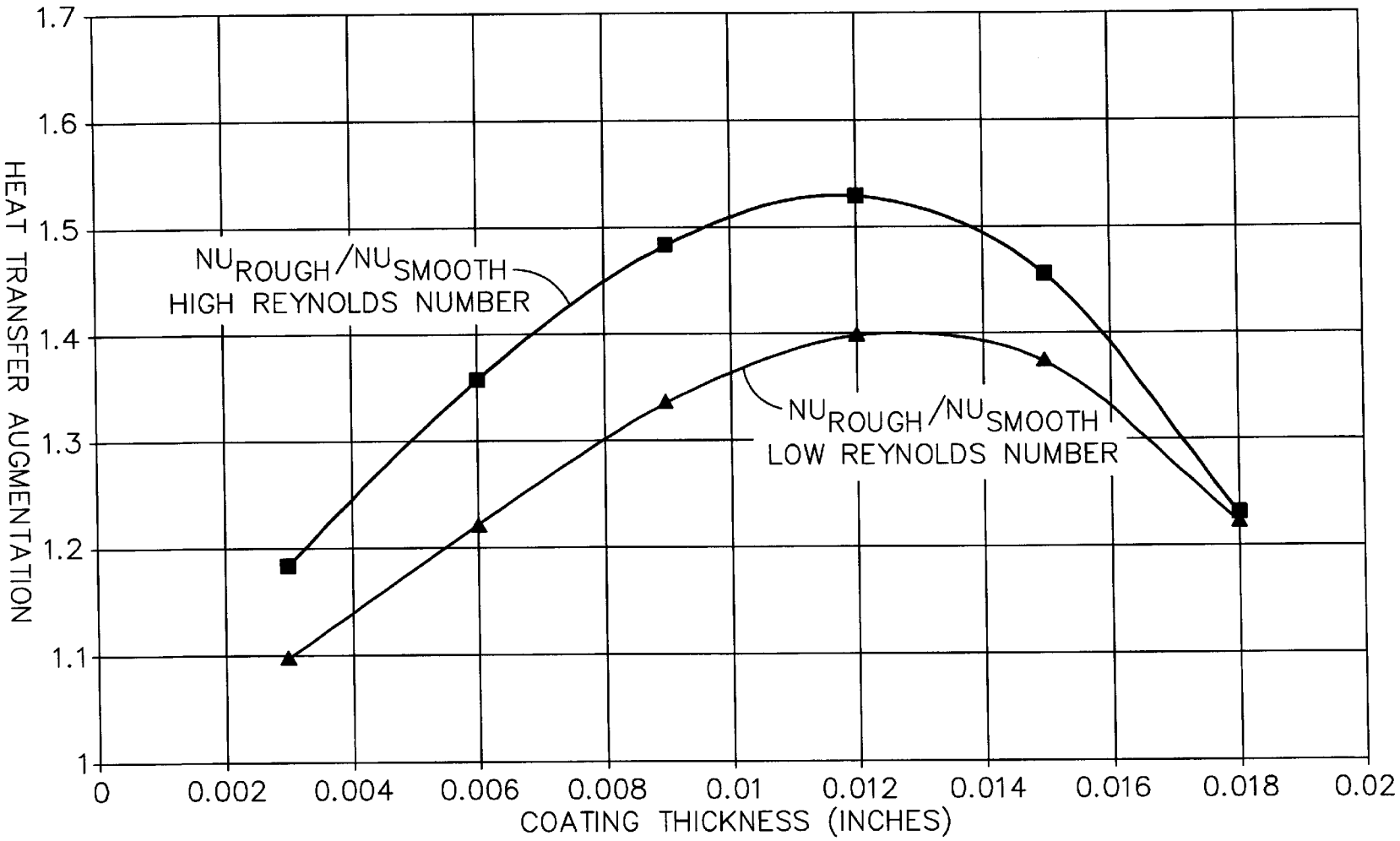
FIG. 3 is a graph showing the effect of coating thickness on heat transfer augmentation.
Figure 4:
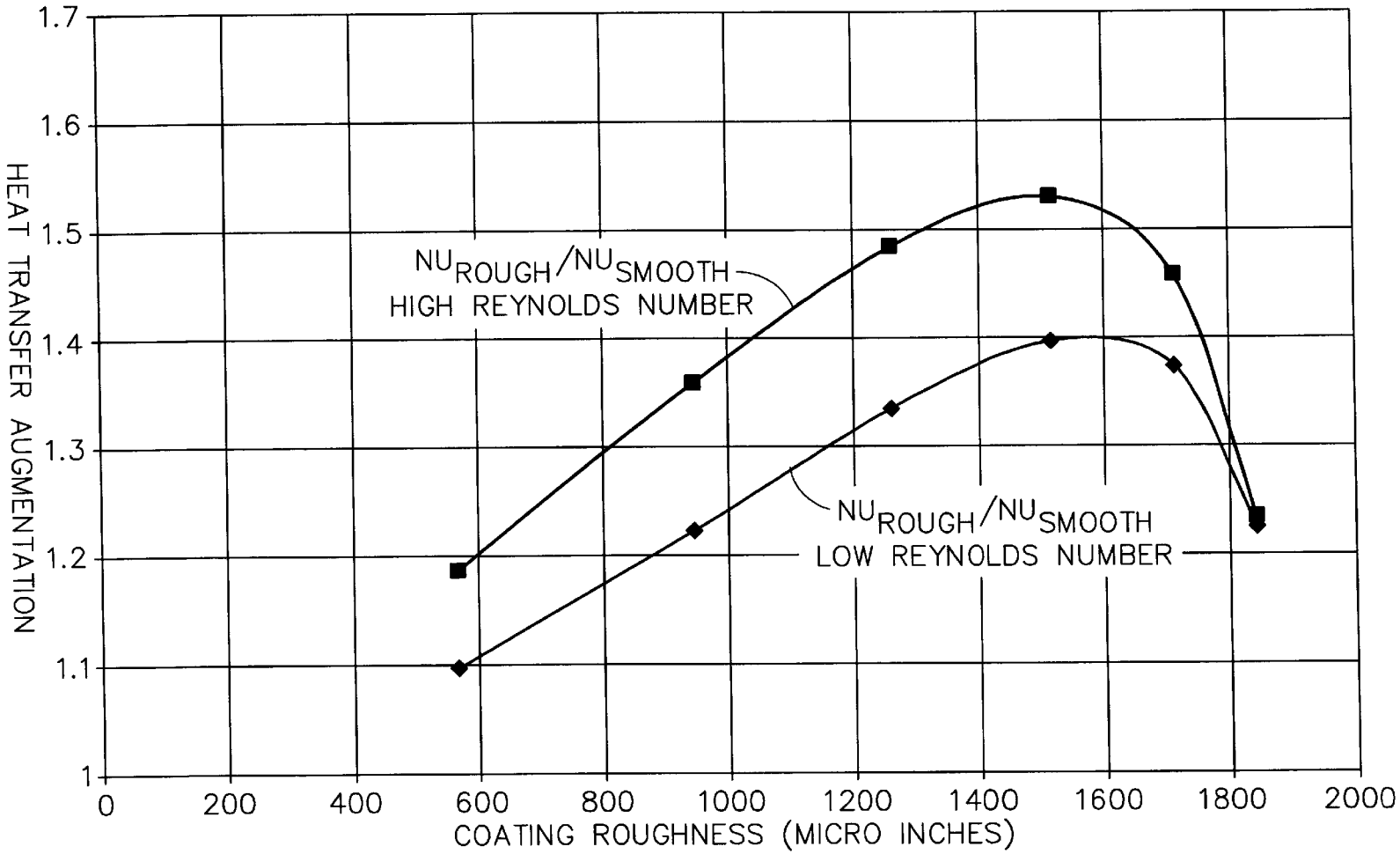
FIG. 4 is a graph showing the effect of coating surface roughness on heat transfer augmentation.

During a further evaluation of the present invention, specimens of substrates of high temperature nickel base and cobalt base superalloys, commercially available as In 718 alloy and HS 188 alloy, were electric arc spray coated with a high temperature metal coating representative of and selected from a group of coatings based on Fe, Co or Ni, or their combinations. Sometimes these coating alloys are referred to as the M—Cr—Al alloys in which the M is Fe, Co, Ni, or their combination. Used in these examples was a Ni—Cr—Al—Y type of metallic coating consisting nominally by weight of 21.5% Cr, 10% Al, 1% Y, with the balance Ni. This coating material being metallic inherently has a relatively high coefficient of thermal conductivity as compared with non-metallic materials. Various conditions of surface roughness and coating thickness were evaluated for their effect on heat transfer augmentation from the substrate. The graphs of FIGS. 3 and 4 summarize an evaluation, and include data for NUrough/NUsmooth at a range of Reynolds numbers. NUrough/NUsmooth means the ratio of Nusselt number calculated for a roughened surface to Nusselt number calculated for a smooth surface, the ratio representing heat transfer augmentation.

From this example which generated the data represented in FIG. 3, in order to attain a heat transfer augmentation of at least about 1.3–1.5 according to a preferred form of the invention, the average coating thickness must be at least about 0.008" and less than about 0.017". This form provides a 30–50% improvement in heat transfer. Improvement from the combination of the present invention can be achieved from a coating thickness of about 0.003" for a heat transfer augmentation of about 1.1. From the data represented in FIG. 4, in order to attain a heat transfer augmentation of at least about 1.3–1.5 according to a preferred form of the invention, the coating roughness must be greater than about 1180 micro inches Ra up to about 1700 micro inches Ra. However, an augmentation of about 1.1 can be achieved at a coating roughness of about 500 micro inches Ra. The roughness data presented herein were obtained from measurements made with a skidded contact profilometer using a stroke cut-off length of 0.100" The thickness was determined using a 0.250" diameter flat anvil micrometer. According to a preferred form of the present invention, a metallic article surface layer, for example a coating, is provided for augmentation of heat transfer from an article substrate. Such metallic surface layer is characterized by a relatively high coefficient of thermal expansion, and a thickness in the range of about 0.008"–0.017", in combination with an average surface roughness of greater than about 1180 micro inches Ra, and preferably up to about 1700 micro inches Ra.

Figure 5:
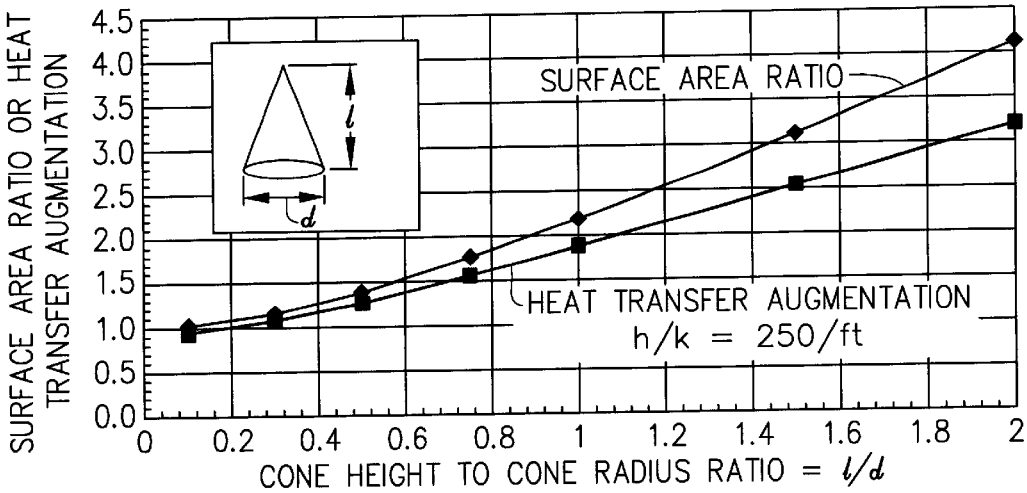
FIG. 5 is a graph showing the effect of geometry on area ratio and heat transfer.

In one evaluation of the present invention, roughness modeling of the layer or coating was conducted to determine the effect of the geometry of the roughness on area ratio and heat transfer. In this example, a layer in the form of a coating of the above described Ni—Cr—Al—Y alloy was used. The graph of FIG. 5 summarizes data from that evaluation. Heat transfer augmentation h/k=250/ft is the ratio of heat transfer coefficient to thermal conductivity; and surface area ratio is the ratio of surface area for a rough surface to the surface area for a smooth surface. The data of FIG. 5 show that according to the combination of the present invention, heat transfer augmentation of at least about 1.1 and as high as about 3.5, representing an augmentation in the range of about 10–350%, can be achieved.

Figure 6:
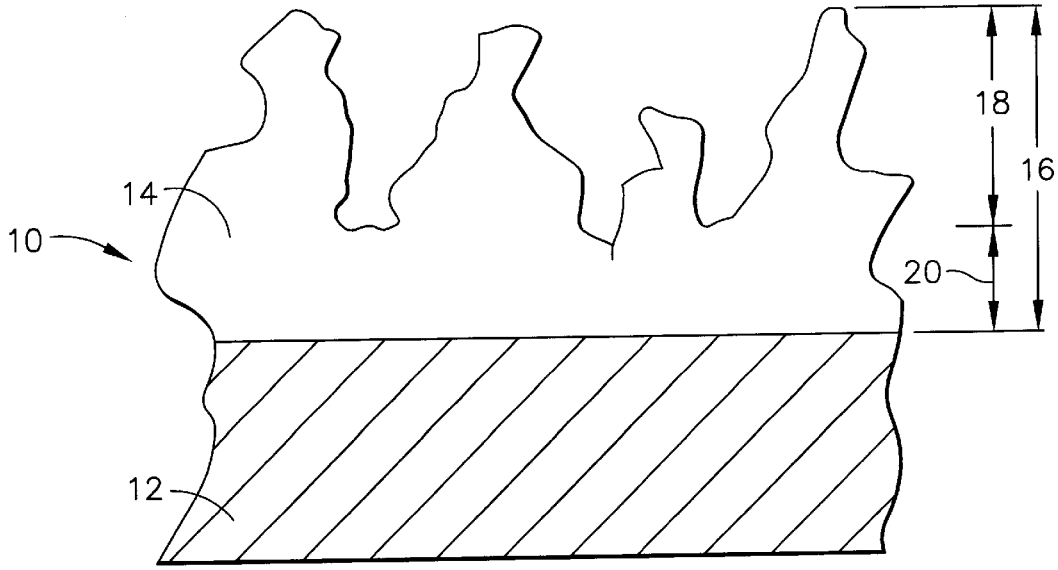
FIG. 6 is a diagrammatic, fragmentary, sectional view of a coating as a surface layer on a metal substrate of an article.

The diagrammatic, fragmentary sectional view of FIG. 6 includes a metallic surface layer shown generally at 10 in the form of an electric arc wire sprayed metal coating of the above identified Ni—Cr—Al—Y type alloy deposited on and bonded with a metal substrate 12. According to a preferred form of the present invention, layer or coating 14 has a total coating thickness 16 in the range of from about 0.008" up to about 0.017", taken as an average of total thicknesses. Coating 14 has a surface roughness portion 18 of at least about 1180 micro inches Ra, and preferably about 1200–1700 micro inches Ra. The balance of the coating or layer is inner portion 20, which together with roughness portion 18 defines coating thickness 16. As inner portion 20 increases in thickness, it tends to resist transfer of heat from substrate 12. Therefore, too thick an inner layer is undesirable. With a surface roughness of at least about 500 micro inches Ra, and preferably at least about 1180 micro inches Ra, as defined by the present invention, increase in the thickness of inner portion 20 to provide a total layer or coating of a thickness greater than about 0.017" according to the present invention can reduce the rate of heat transfer from the substrate.

To provide the above described metallic layer according to the present invention, a variety of methods can be used, including the known and commercially used thermal spray type of processes. One thermal spray type process which has been used and is preferred in connection with the present invention is an electric arc spray process using a metallic wire. Generally in electric arc wire spraying, at least two wires of the same, similar or different materials are melted by an electric arc, atomized into particles and the molten particles are propelled by a high velocity gas stream, such as of an inert or reducing gas or air, onto an article surface to bond with the surface and to each other in the build up of a surface coating or layer. The process parameters of such a process can be adjusted readily to provide the layer requirements of the present invention.

In one series of examples, article substrates of a the above described high temperature base superalloys were prepared by grit blasting to enhance surface bonding of molten droplets propelled from an electric arc wire spray process. The metallic wire used in these examples with that process to provide the above described Ni—Cr—Al—Y alloy as a surface layer comprised a Ni—Cr sheath filled with Ni and Cr particles and with Al and Y powder. The wire was used in a twin wire electric arc spray process in which the wires were held at a spray distance of about 3–4" from the substrate. Other processing parameters included a current of about 150–300 amps at a voltage of about 27–33 d.c. For atomizing of the molten wire, an air pressure of about 20–40 psi was used. Resulting from these examples were a series of layers or coatings of the Ni—Cr—Al—Y alloy well bonded to substrates and having a total thickness 16, FIG. 6, in the range of about 0.01–0.16" in combination with a surface roughness 18 in the range of about 1200–1700 micro inches Ra. The tensile bond strength of each layer in these examples was at least about 5 ksi. and generally in the range of about 6–12 ksi.

During evaluations such as those described above, electric arc wire spray process parameters were considered within the ranges of about 100–500 amps of electric current, distance between spray gun and substrate of about 2–8", and an air pressure of about 20–80 psi to atomize the molten wire metal and propel droplets toward and into contact with the substrate. It was recognized that atomizing air pressure was the only significant variable in order to control the surface layer according to the present invention, with lower air pressure resulting in higher roughness. Therefore, according to one form of the present invention in which the electric arc wire spraying is used to deposit the surface layer, it was recognized that the atomizing air pressure be maintained within the range of about 20–80 psi, and preferably about 20–40 psi at a gun to substrate distance of about 3–4". At an air pressure below about 20 psi, cooling of the arc spray gun was reduced below the minimum required to cool the gun during operation. As a result, melting of the gun components can occur. At an air pressure above about 80 psi, particle velocity was increased and coating roughness was decreased, reducing cooling augmentation below a desired level.

The present invention has been described in connection with specific examples and embodiments which are intended to be typical of rather than in any way limiting on its scope. Those skilled in the arts involved will understand that the invention is capable of variations and modifications without departing from the scope of the appended claims.

What is claimed is:

1. An article comprising a substrate and a metallic outer surface layer, the layer augmenting heat transfer from the substrate through the combination of:

a layer thickness in the range of about 0.008" to about 0.017";

a layer surface roughness of greater than about 500 micro inches Ra; and, a heat transfer augmentation of at least about 1.1.

2. The article of claim 1 in which the heat transfer augmentation is in the range of about 1.1–3.5.

3. The article of claim 2 in which:

the layer has a layer tensile bond strength of at least about 5 ksi;

the layer thickness is in the range of about 0.008–0.017"; and, the layer surface roughness is greater than about 1180 micro inches Ra.

4. The article of claim 3 in which:

the layer thickness is in the range of about 0.01–0.016";

the layer surface roughness is in the range of about 1200–1700 micro inches Ra;

the layer tensile bond strength is at least about 10 ksi; and, the heat transfer augmentation is about 1.3–1.5.

5. The article of claim 4 in which the metallic outer surface layer comprises an M—Cr—Al high temperature alloy in which M is at least one element selected from the group consisting of Fe, Co and Ni.

6. The article of claim 5 in which the outer surface layer is a Ni—Cr—Al—Y alloy.

* * * * *